US005356228A

United States Patent [19]

Koyama et al.

[11] Patent Number: 5,356,228

[45] Date of Patent: Oct. 18, 1994

[54] APPARATUS FOR DRIVING ADJACENT ELEMENTS IN A WIRE-DOT PRINT HEAD

[75] Inventors: Tatsuya Koyama; Hirokazu Andou; Kiyoshi Ikeda, all of Tokyo, Japan

[73] Assignee: Oki Electric Industry Co., Ltd., Tokyo, Japan

[21] Appl. No.: 991,759

[22] Filed: Dec. 17, 1992

Related U.S. Application Data

[63] Continuation of Ser. No. 665,902, Mar. 7, 1991, abandoned.

[30] Foreign Application Priority Data

Mar. 9, 1990 [JP] Japan ..... 2-56719

[51] Int. Cl.[5] ..... B41J 2/30

[52] U.S. Cl. ..... 400/124.02; 400/157.3

[58] Field of Search ..... 400/121, 124, 157.2, 400/157.3, 166

[56] References Cited

U.S. PATENT DOCUMENTS

| | | | |
|---|---|---|---|
| 4,473,311 | 9/1984 | Sakaido | 400/157.2 |
| 4,627,344 | 12/1986 | Costello | 101/93.03 |
| 5,071,268 | 12/1991 | Tanuma | 400/124 |

FOREIGN PATENT DOCUMENTS

| | | | |
|---|---|---|---|
| 0294288A3 | 12/1988 | European Pat. Off. | B41J 3/10 |
| 156271 | 9/1982 | Japan | 400/129 |
| 34171 | 2/1988 | Japan | 400/121 |
| 64-53860 | 6/1988 | Japan | 400/124 |
| 63-34171A | 7/1988 | Japan | B41J 9/38 |
| 63-30154 | 3/1989 | Japan | 400/124 |
| 2-1288459A | 2/1990 | Japan | B41J 3/10 |

*Primary Examiner*—David A. Wiecking
*Assistant Examiner*—Steven S. Kelley
*Attorney, Agent, or Firm*—Edward D. Manzo

[57] ABSTRACT

In a wire dot printer having a wire-dot print head provided with wire drive elements disposed in sequence, the energization of the respective wire drive elements is controlled in accordance with print data supplied for respective drive elements and a drive time signal supplied in common to a plurality of the drive elements. Detection is made, for each drive element, whether or not an adjacent drive element is energized, in accordance with the print data corresponding to the adjacent drive element, and the energization time for the particular drive element is controlled in accordance with the result of the detection.

12 Claims, 9 Drawing Sheets

FIG. 5

| | | | | | | | | | | | | | | |
|---|---|---|---|---|---|---|---|---|---|---|---|---|---|---|
| #1 | #3 | #5 | #7 | #9 | #11 | #13 | #15 | #17 | #19 | #21 | #23 | #24 | #22 | #20 |
| a | b | c | d | e | f | g | h | i | j | k | l | m | n | o |
| #18 | #16 | #14 | #12 | #10 | #8 | #6 | #4 | #2 | | | | | | |
| p | q | r | s | t | u | v | w | x | | | | | | |

TIMING SIGNAL GENERATING CIRCUIT
31
DT2
STP
ST1
ST2
32 ON-TIMING SIGNAL SELECTING CIRCUIT
32a
32b
32c
32x
33 DRIVE TIME SIGNAL GENERATING CIRCUIT
33a
33b
33c
33x
DT1-1
DT1-3
DT1-5
DT1-2
#2 #5 #3 #1
PRINT DATA
'0 or 1'
20 DETECTING CIRCUIT
21a
21b
21c
21x
22a
22b
22c
22x
PRINT DATA #1
3
5
23
24
2

APPARATUS FOR DRIVING ADJACENT ELEMENTS IN A WIRE-DOT PRINT HEAD

This is a continuation of copending application Ser. No. 07/665,902, filed on Mar. 7, 1991, now abandoned.

FIELD OF THE INVENTION

The present invention relates to a method of driving a wire-dot print head in a serial printer, and a device for driving a wire-dot print head using the method.

BACKGROUND OF THE INVENTION

Conventionally, various types of wire-dot print heads for use in a wire-dot printer have been known. Spring-charged wire-dot print heads are widely used in applications where high speeds and high printing forces are desired. FIG. 1 is a sectional view of a wire-dot print head of the spring charge type.

In the figure, print wires 1 extend generally parallel with each other. The front or forward (upper as seen in the figure) parts of the print wires 1 extend through an aperture 8*a* provided in the front end of a nose 8*b* forming the front part of a wire guide 8. When the print wires 1 are driven forward, in a manner later described, their front ends strike a print medium, such as print paper PP on platen PL via an ink ribbon IR thereby performing wire-dot printing.

Rear (lower as seen in the figure) ends of the print wires 1 are fixed to inner or first ends of armatures 2 which are disposed to extend radially. A plate spring 3 comprises radial parts 3*a* which are fixed to rear surfaces of outer or second ends of the armatures 2. The plate spring 3 also comprises an annular part 3*b* which is integrally connected the outer ends of the radial parts 3*a* and is clamped between the front end of a cylindrical permanent magnet 4 and the rear surface of an annular part 5*b* of a front yoke 5.

The front yoke 5 also comprises radial parts 5*a* having outer ends integrally connected by the annular part 5*b*. Each armature 2 is positioned between adjacent radial parts 5*a* of the front yoke 5, with a slight gap on each side. Cores 6 extend from a disk-shaped base yoke 10 forward and their front ends are facing the lower surfaces of the armatures 2. Coils 7 are wound oil the cores 6 to form electromagnets EM for the respective armatures 2 and hence for the respective print wires 1. The rear end of the cylindrical permanent magnet 4 is connected to the periphery of the disk-shaped base yoke 10. The permanent magnet 4, the annular part 3*b* of the plate spring 3, the annular part 5*b* of the front yoke 5 and an annular part 8*c* of the wire guide 8 form a cylindrical wall of the print head.

The magnetic flux from the permanent magnet 4 passes through the annular part 5*b* of the front yoke 5, the radial parts 5*a* of the front yoke 5, the armatures 2, the cores 6 and the base yoke 10, thereby attracting the armatures 2 toward the cores 6, bending the radial parts 3*a* of the plate spring 3. When the electromagnets EM are energized to generate a magnetic flux canceling the magnetic flux from the permanent magnet 4, the armatures 2 are released and the print wires 1 are driven forward by virtue of the recovery force of the plate spring 3.

Further details of this action are described in, for example, Japanese Patent Kokai Publication No. 53860/1989. The period for which the electromagnets are energized is determined by a drive time signal $DT_1$ shown in FIG. 2. Another drive time signal $DT_2$ is used to provide, subsequent to the energization time, a period PR1 in which currents due to the electromotive forces induced in the electromagnets are allowed to flow through a certain current path. Subsequent to the first period, currents which are also due to electromotive forces, flow through another current path for a certain period, denoted PR2, until the current falls to zero.

An assembly, particularly the electromagnet EM, for driving a single print wire will be called a wire drive element. The wire-dot print head has a multiplicity of, e.g., 24, drive elements. They are disposed in an array or in sequence along a ring as shown in FIG. 3. In FIG. 3, the positions of the drive elements, particularly the electromagnets on the disk-shaped base yoke 10 are illustrated. They are numbered, as #1, #2, #3, and so on, in the order in which the front ends of the corresponding print wires 1 are arranged from top to bottom. The electromagnets are disposed along the circle in counterclockwise sequence, arranged in the order of #1, #3, #5, . . . #2.

For the purpose of reducing the size and cost of the wire-dot print head, the base yoke 10 to which the cores 9 are fixed, the permanent magnet 4, and the front yoke 5 and the like are formed as an integral unit, and for this reason much of the magnetic circuit of the drive element is shared. As a result, magnetic flux generated from one drive element enters a magnetic circuit of an adjacent drive element, creating a magnetic interference which brings about a variation in the magnetic circuit of the above-mentioned adjacent drive element. This magnetic interference not only increases the exciting current of the coil, but also creates considerable influences on the printing operation of the armatures, such as shifting the timing of the release of armatures. These variations in armature operation due to the magnetic interference are becoming a larger problem as the speed and the printing force of the wire-dot print head are increased.

Systems have been proposed in which the time for which currents are made to flow through the coils, i.e., the time for which the coils are energized, are varied depending on the number of the coils that are simultaneously excited, and these systems are used as an effective means for reducing the above-discussed problem. One of such systems is disclosed in Japanese Patent Kokoku Publication No. 30154/1988. According to this publication, the time for which coils are energized is varied by providing: means for detecting print data signals supplied to the respective electromagnets and the number of electromagnets that are simultaneously driven responsive to the signals, means actuated in accordance with timing signals generated every predetermined pitch of movement of wire drive element, means supplying a time signal having a length corresponding to the number of the electromagnets, and means gating the print data signals with the time signal to produce drive signals for the electromagnets.

In the conventional wire-dot printers, the control is made based solely on the number of the coils which are energized, so the printing operations of the armatures are not necessarily constant. For instance, the magnetic interference gives a significant influence on the adjacent drive elements, and the degree of interference differs much depending on whether or not adjacent electromagnets are simultaneously driven. Usually, the time for which coils are energized is varied to minimize the influence with the combination of pins giving the worst armature operations. For this reason, with respect to the combination of pins for which the time coils are energized may be short, more energy than necessary is supplied to the coils, and the heating of the coils is increased, and the printing forces are excessive.

Explanation will now be made regarding the influence on the armature operations both in a situation in which adjacent drive elements are simultaneously driven and a situation in which adjacent drive elements are not simultaneously driven. As described earlier, the magnetic interference gives the largest influence on an adjacent drive element, and the greater the separation of drive elements, the smaller is the influence. The influence appears as the variation in the inductance of the magnetic circuit of the drive element, and the phenomena vary depending on the number and positions of elements that are simultaneously driven. The phenomena also vary depending on the structure and the material of the wire-dot print head. It is therefore difficult to determine whether the magnetic interference accelerates or retards the operation of the armatures.

An object of the present invention is therefore to optimize the time for which each drive element is energized.

Another object of the invention is to optimize the energization time for each drive element taking account of the magnetic interference from an adjacent drive element.

SUMMARY OF INVENTION

The invention provides a method and a device for a wire-dot printer having a wire-dot print head provided with wire drive elements disposed in sequence, the energization of the respective wire drive elements is controlled in accordance with print data supplied for respective drive elements and a drive time signal supplied in common to a plurality of the drive elements. Detection is made, for each drive element, to determine whether or not an adjacent drive element is energized, in accordance with the print data corresponding to the adjacent drive element, and the energization time for the drive element is controlled in accordance with the result of the detection.

BRIEF DESCRIPTION OF THE DRAWINGS

FIG. 5 is a diagram showing the arrangement of the drive elements on the base yoke.

DETAILED DESCRIPTION OF THE PREFERRED EMBODIMENTS

Embodiments of the invention will now be described with reference to the drawings. Identical elements throughout various figures are denoted by identical reference marks.

First Embodiment

Figure 4:
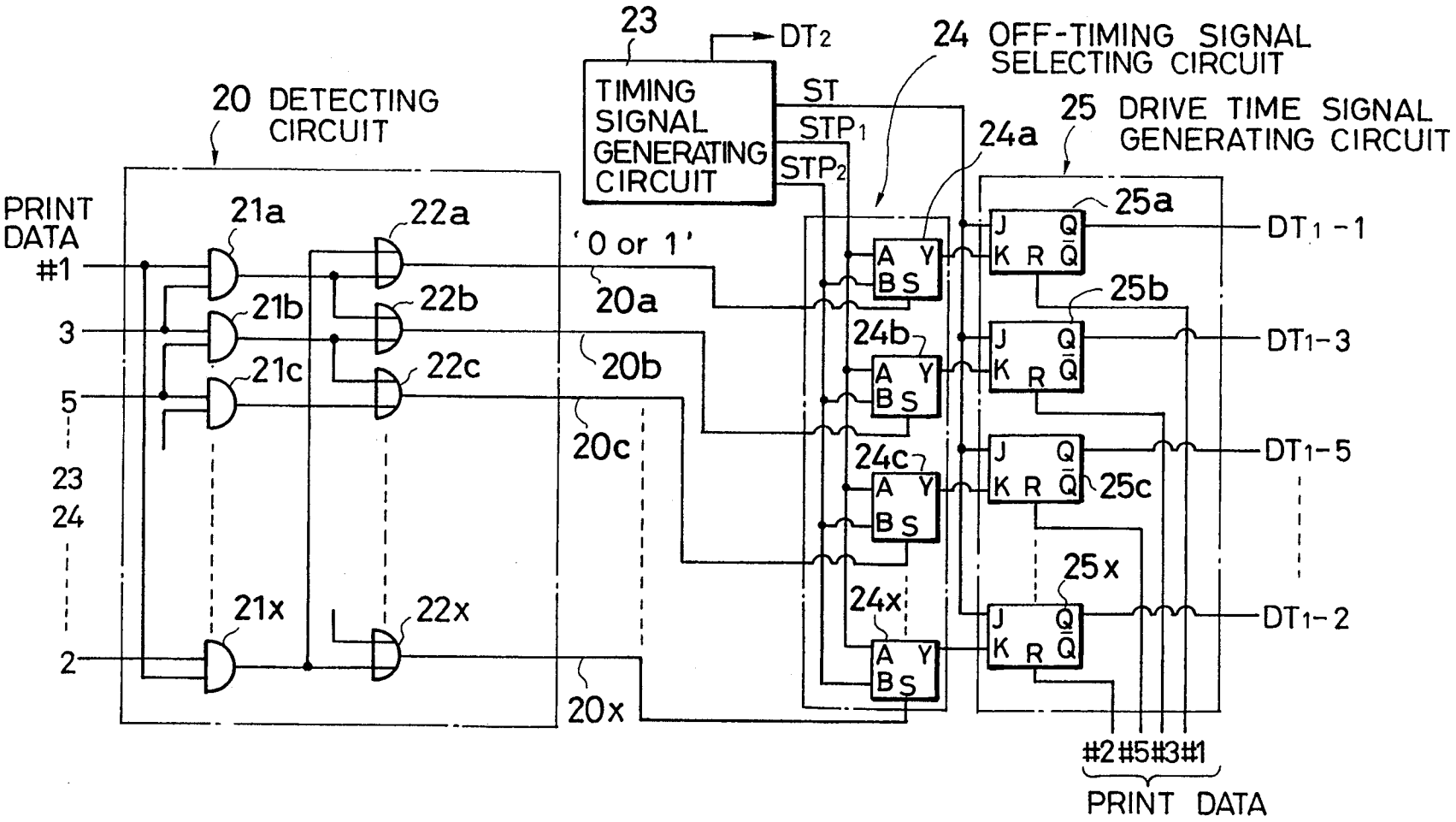
FIG. 4 is a diagram showing a drive control circuit for a print head.

FIG. 4 is a circuit diagram showing a print head drive control circuit of an embodiment of the invention. Print data #1, #3, #5, . . . #2 are supplied, each print cycle, from a print data generating unit, not shown, for respective drive elements and hence for respective print wires 1 and determine whether the corresponding print wires 1 are to be driven during the particular print cycle. Identical reference marks #1, #3, #5, . . . , #2 are used to correlate the print data with the drive elements for which the print data are generated.

The print data are input to a detecting circuit 20 as well as to drive circuits later described.

The detecting circuit 20 detects, for each drive element, whether each drive element and at least one of the drive elements adjacent to the first-mentioned drive element are to be energized in the particular print cycle. This detection is made in accordance with the print data #1, #3, #5, . . . , #2. The results of the detection are detection signals 20*a*, 20*b*, 20*c*, . . . , 20*x*. The alphabetical suffixes a, b, c, . . . , x respectively correspond to #1, #3, #5, . . . , #2 of the drive elements. FIG. 5 shows the correspondence between the number (#) of each of drive elements and the alphabetical suffixes of each detection signal.

Figure 1:
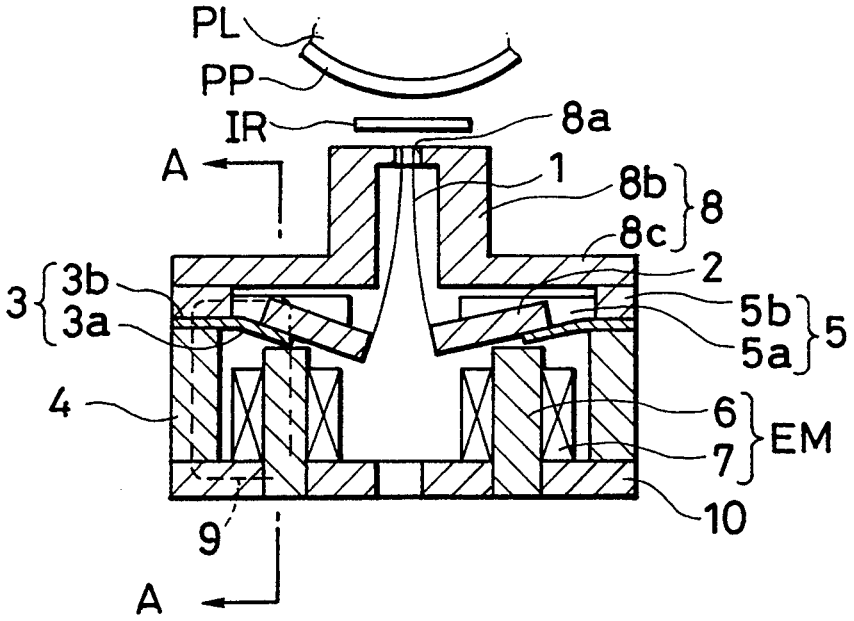
FIG. 1 PRIOR ART
FIG. 1 is a sectional view of a typical print head.
Figure 3:
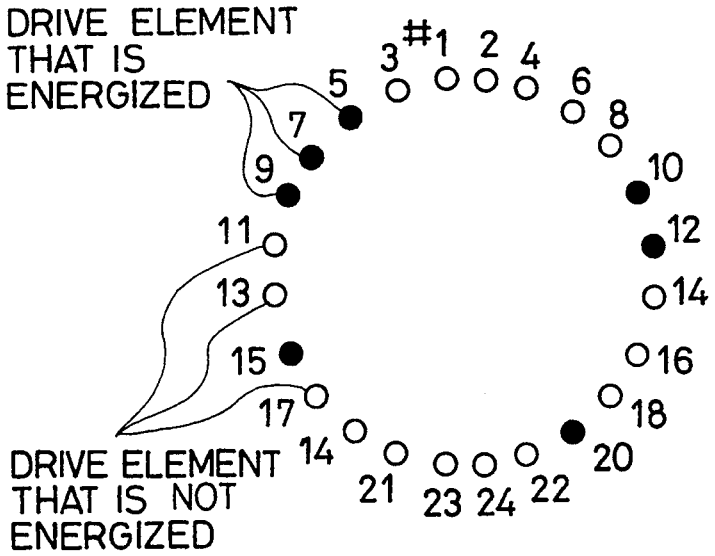
FIG. 3 PRIOR ART
FIG. 3 is a diagram showing the arrangement of the drive elements.
Figure 2:
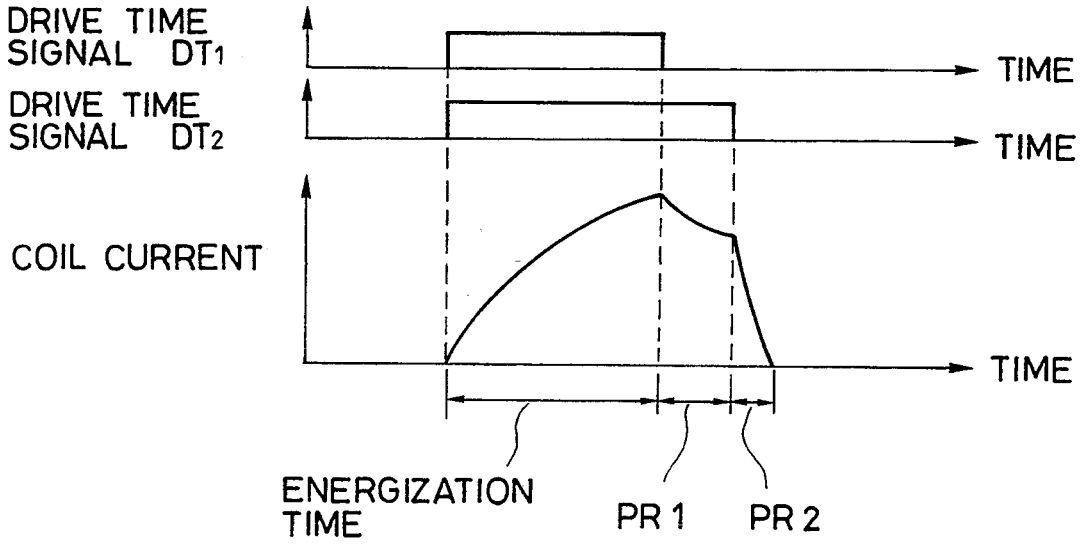
FIG. 2 PRIOR ART
FIG. 2 is a waveform diagram of the drive circuit in the prior art.

The detecting circuit 20 comprises logical product circuit (hereinafter referred to as AND gates) 21*a*, 21*b*, 21*c*, . . . , 21*x*, and logical sum circuits (hereinafter referred to as OR gates) 22*a*, 22*b*, 22*c*, . . . , 22*x*. The AND gates 21*a* receive print data #1 and #3. The AND gate 21*b* receives print data #3 and #5. The AND gate 21*c* receives print data #5 and #7. The last AND gate 21*x* receives print data #1 and #2. That is, two print data which are for drive elements adjacent to each other in the circular sequence in which they are disposed as shown in FIG. 3 are applied to inputs of each of the AND gates 21*a*, 21*b*, 21*c*, . . . , 21*x*.

The OR gate 22*a* receives the output signals from the AND gates 21*a* and 21*x*. The OR gate 22*b* receives the output signals from the AND gates 21*a* and 21*b*. The OR gate 22*c* receives the output signals from the AND gates 21*b* and 21*c*. That is, the OR gates 22*b* to 22*x* receive the output signals of pairs of AND gates 21*a* to 21*x* in the front stage that are adjacent to each other. The OR gate 22*a* receives the output signals of the AND gate 21*a* of the uppermost position and the AND gate 21*x* of the lowermost position. Thus, the AND gates of each of said pairs receive one common print data for a certain drive element, and two print data which are for drive elements adjacent, on both respective sides, to said certain drive element.

Each of the AND gates 21*a*, 21*b*, 21*c*, . . . , 21*x* detects whether the print data for each drive element and the drive element next (in the order of arrangement) to the first-mentioned drive element are both active, meaning that these two drive elements are to be energized in the particular print cycle.

Each of the OR gates 22a, 22b, 22c, . . . , 22x detects whether the print data for the corresponding drive element and at least one of the drive elements adjacent to the first-mentioned drive element are both active.

When the detecting circuit 20 finds, on the basis of the input print data, that the print data for the corresponding drive element as well as one or both of the print data for the drive elements adjacent to the first-mentioned drive element in question are both at "1", it generates the detection signal of "1" for the particular drive elements. Otherwise, it generates the detection signal of "0" for the particular print data.

The timing signal generating circuit 23 generates an on-timing signal ST, and off-timing signals $STP_1$, $STP_2$ in time with the generation of the print data. Responsive to the on-timing signal ST, the drive time signals $DT_{1-1}$, $DT_{1-3}$, $DT_{1-5}$, . . . , $DT_{1-2}$ for the respective drive elements are turned on. Responsive to the off-timing signals $STP_1$, $STP_2$, the drive time signals $DT_{1-1}$, $DT_{1-3}$ $DT_{1-5}$, . . . , $DT_{1-2}$ for the respective drive elements are turned off. The drive time signal $DT_2$ is also generated, with its on-timing (leading edge) and off-timing (trailing edge) being coincident with that in the prior art.

The off-timing signal selecting circuit 24 comprises data selectors 24a, 24b, 24c, . . . , 24x, which receive, at the input terminals A and B, the off-timing signals $STP_1$ and $STP_2$ generated by the timing signal generating circuit 23. Each of the data selectors receives, at its data select terminal S, the corresponding detection signal from the detecting circuit 20, and when the signal at terminal S is at "1" it selects the signal being input to terminal A and output the selected signal through the output terminal Y. When the signal at the select terminal S at "0" the data selector selects the signal being input at terminal B and outputs the selected signal through the output terminal Y.

The drive time signal generating circuit 25 comprises JK flip-flops 25a, 25b, 25c, . . . , 25x. Input to the J terminal of each JK flip-flop is the on-timing signal ST generated by the timing signal generating circuit 23. Input to the K terminal of each JK flip-flop is the output of the corresponding data selector of the off-timing signal selecting circuit 24. Input to the reset terminals R of the JK flip-flops 25a, 25b. 25c, . . . , 25x are print data #1, #3, #5, . . . , #2. The output signals $DT_{1-1}$, $DT_{1-3}$, $DT_{1-5}$, . . . , $DT_{1-2}$ of the JK flip-flops are the drive time signals for controlling the coil currents through the drive elements #1, #3, #5, . . . , #2, and are used in place of the drive time signal $DT_1$ in the prior art. The drive time signal for each drive element of which an adjacent drive element is driven is turned on responsive to the on-timing signal ST and is turned off responsive to the off-timing signal $STP_1$. The drive time signals for other drive elements are turned on responsive to the on-timing signal ST and are turned off responsive to the off-timing signal $STP_2$.

Figure 6:
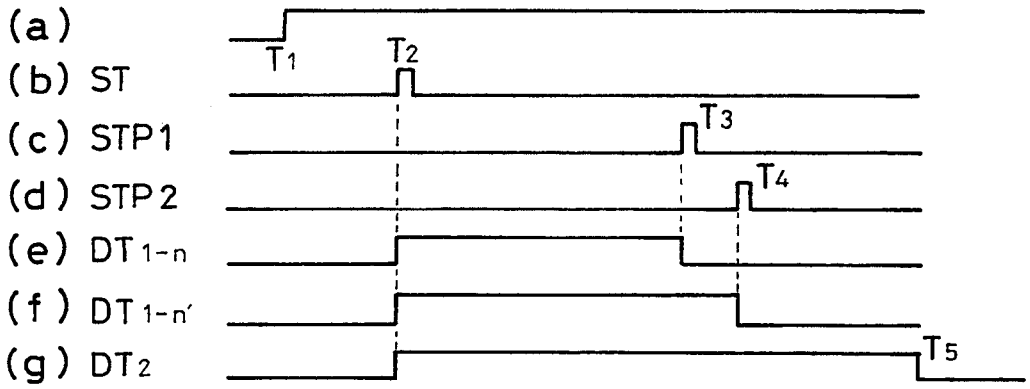
FIG. 6 is a time chart of the drive control circuit for the print head.

FIG. 6 is a time chart of the print head drive control circuit in FIG. 4. FIG. 6 shows, at (a), the print data #1, #3, #5, . . . , #2. FIG. 6 shows, at (b), (c) and (d), respectively show the on-timing signal ST, and the off-timing signals $STP_1$ and $STP_2$ generated by the timing signal generating circuit 23. FIG. 6 shows, at (e), the drive time signal $DT_{1-n}$ which is turned on and off responsive to the on-timing signal ST and the off-timing signal $STP_1$. FIG. 6 shows, at (f), the drive time signal $DT_{1-n'}$ which is turned on and off responsive to the on-timing signal ST and the off-timing signal $STP_2$. In the reference marks, the suffixes "n" and "n'" correspond to the numbers of the drive elements. FIG. 6 shows, at (g), the drive time signal $DT_2$.

Figure 7:
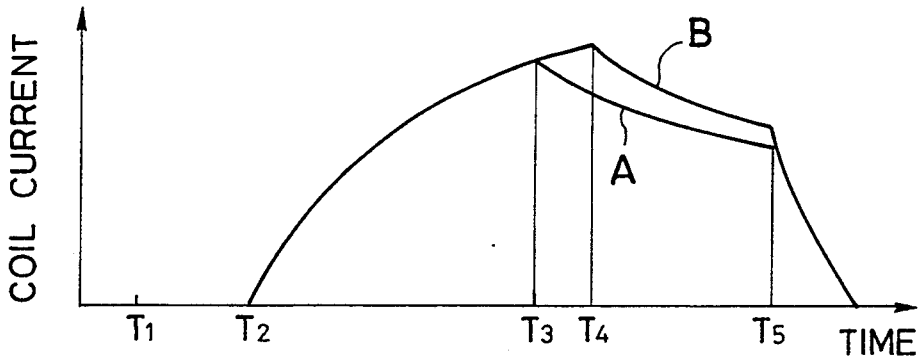
FIG. 7 is a waveform diagram of the coil current corresponding to FIG. 6.

FIG. 7 shows waveforms of the coil currents corresponding to FIG. 6. The waveform A is obtained when the drive time signal $DT_{1-n}$ is used, while the waveform B is obtained when the drive time signal $DT_{1-n'}$ is used.

Figure 8:
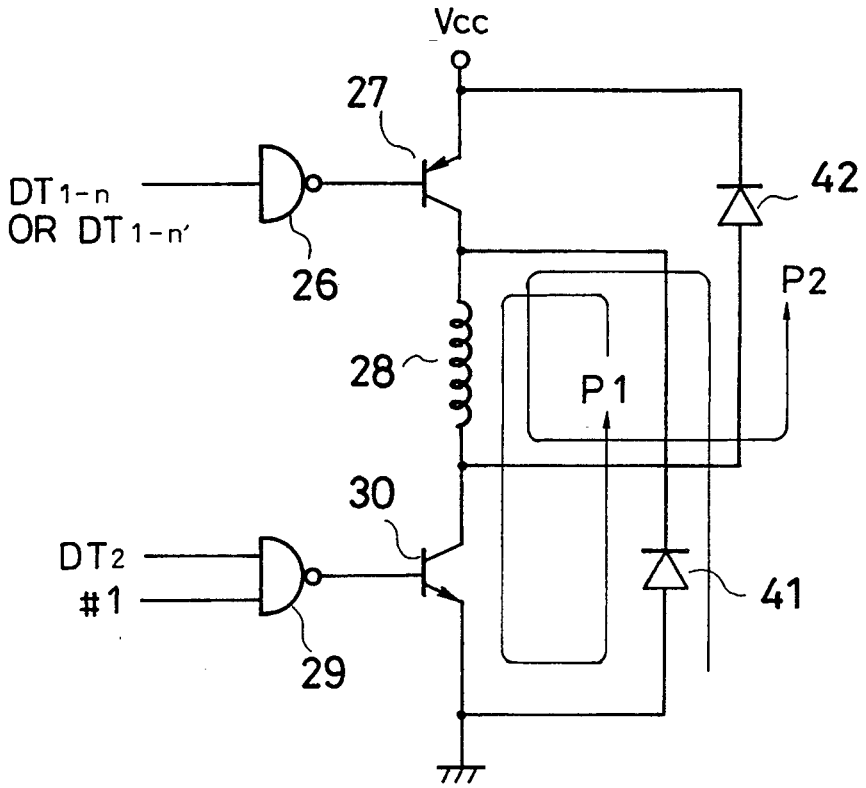
FIG. 8 is a circuit diagram showing part of the drive circuit.

FIG. 8 shows part of the drive circuit for a single drive element. The drive time signal $DT_{1-n}$ or $DT_{1-n'}$ is inverted at the inverter 26, and is input to the base of a PNP transistor 27. The drive time signal $DT_2$ is input to an AND gate 29 together with print data, and their logical product is determined, and input to the base of an NPN transistor 30. Connected to the collector of the transistor 27 is a first end of a coil 28. Connected to the collector of the transistor 30 is a second end of the coil 28. Connected to the emitter of the transistor 27 is a power supply Vcc, and the emitter of the transistor 30 is connected to the ground. A diode 41 is connected across the series connection of the coil 28 and the transistor 30, with its anode connected to the emitter of the transistor 30 and its cathode connected to the first end of the coil 28. Another diode 42 is connected across the series connection of the transistor 27 and the coil 28, with its anode connected to the second end of the coil 28 and with its cathode connected to the emitter of the transistor 27. A circuit similar to that shown in FIG. 8 is provided for each of the drive elements.

The operation will now be described. As an example, it is assumed that the drive elements represented by black dots in the sequence of drive elements shown in FIG. 3, #5, #7, #9, #10, #12, #15 and #20 are to be driven, and the drive elements represented by white dots are not to be driven. This means, the drive elements #5, #7, #9, #10, and #12 and least one of their neighboring drive elements are simultaneously driven, while the drive elements adjacent to the drive elements #15 and #20 are not driven. The print data #1, #3, #5, . . . , #2 are input at time $T_1$ shown in FIG. 6, to the detecting circuit 20 shown in FIG. 4. The detection signals 20c, 20d, 24e, 24s and 24t corresponding to the drive elements #5, #7, #9, #10, and #12 will assume level "1" and other detection signals will assume level "0". As a result, the data selectors 24c, 24d, 24e, 24s and 24t of the off-timing signal selection means 24 select the off-timing signals $STP_1$ and supply it to the drive time signal generating circuit 25. Other data selectors select the off-timing signal $STP_2$, and supply It to the drive time signal generating circuit 25.

At time $T_2$, the on-timing signal ST rises to level "1". The JK flip-flops of the drive time signal generating circuit 25 operate in accordance with clock pulses not shown and the drive time signals $DT_{1-1}$, $DT_{1-3}$, $DT_{1-5}$, . . . $DT_{1-2}$ rise to level "1". The drive time signals $DT_{1-5}$, $DT_{1-7}$, $DT_{1-9}$, $DT_{1-10}$, and $DT_{1-12}$ rise and fall at the timings $T_2$ and $T_3$, like the drive time signal $DT_{1-n}$ shown in FIG. 6 at (e), and other drive time signals rise and fall at $T_2$ and $T_4$ like the drive time signal $DT_{1-n'}$ shown in FIG. 6 at (f). The drive time signal $DT_2$ then will also be at level "1". The drive time signals $DT_{1-1}$, $DT_{1-3}$, $DT_{1-5}$, . . . , $DT_{1-2}$ and the drive time signals $DT_2$ are supplied to the drive circuits of the respective drive elements, like that shown in FIG. 8, and determine, together with the print data for each drive element, whether to energize the coil and when to start and stop the energization.

In the example under consideration, the print data for the coils #5, #7, #9, #10, #12, #15 and #20 are "1" and other print data are at "0". The energization of these coils is commenced at $T_2$. The detection signals for the coils #5, #7, #9, #10, and #12 are at "1", so the energization of the corresponding coils is terminated at $T_3$. On the other hand, the detection signals for the coils #15 and #20 are at "0", so the energization of the corresponding coils is terminated at $T_4$.

The "energization" as used here means turning on both the transistors 27 and 30 for supplying a current from the power supply Vcc, through the coil and to the ground. When the energization is terminated, the transistor 27 is turned off, but the transistor 30 is kept on. Then, due to the electromotive force induced in the coil 28, a current continues to flow through a path P1 consisting of the coil 28, the transistor 30 and the diode 41. The current gradually falls as indicated by curves A and B in FIG. 7. The curve A is for the case in which the energization is terminated at $T_3$, while the curve B is for the case in which the energization is terminated at $T_4$. The transistor 30 is thereafter turned off, at the trailing edge of the drive time signal $DT_2$. The current due to the electromotive force then begins to flow from the ground, through a path P2 consisting of the diode 41, the coil 28, and the diode 42, to the power supply Vcc. The current through the path P2 rapidly falls, as shown in FIG. 7.

As has been described according to the above embodiment, the trailing edges of the drive time signals $DT_{1-1}$, $DT_{1-3}$, $DT_{1-5}$, . . . , $DT_{1-2}$ are controlled in accordance with detection signals indicating whether or not an adjacent drive element is driven. Accordingly, the coil energization time for the drive element which is adjacent can be made shorter than the coil energization time which is not adjacent.

Second Embodiment

Figure 9:
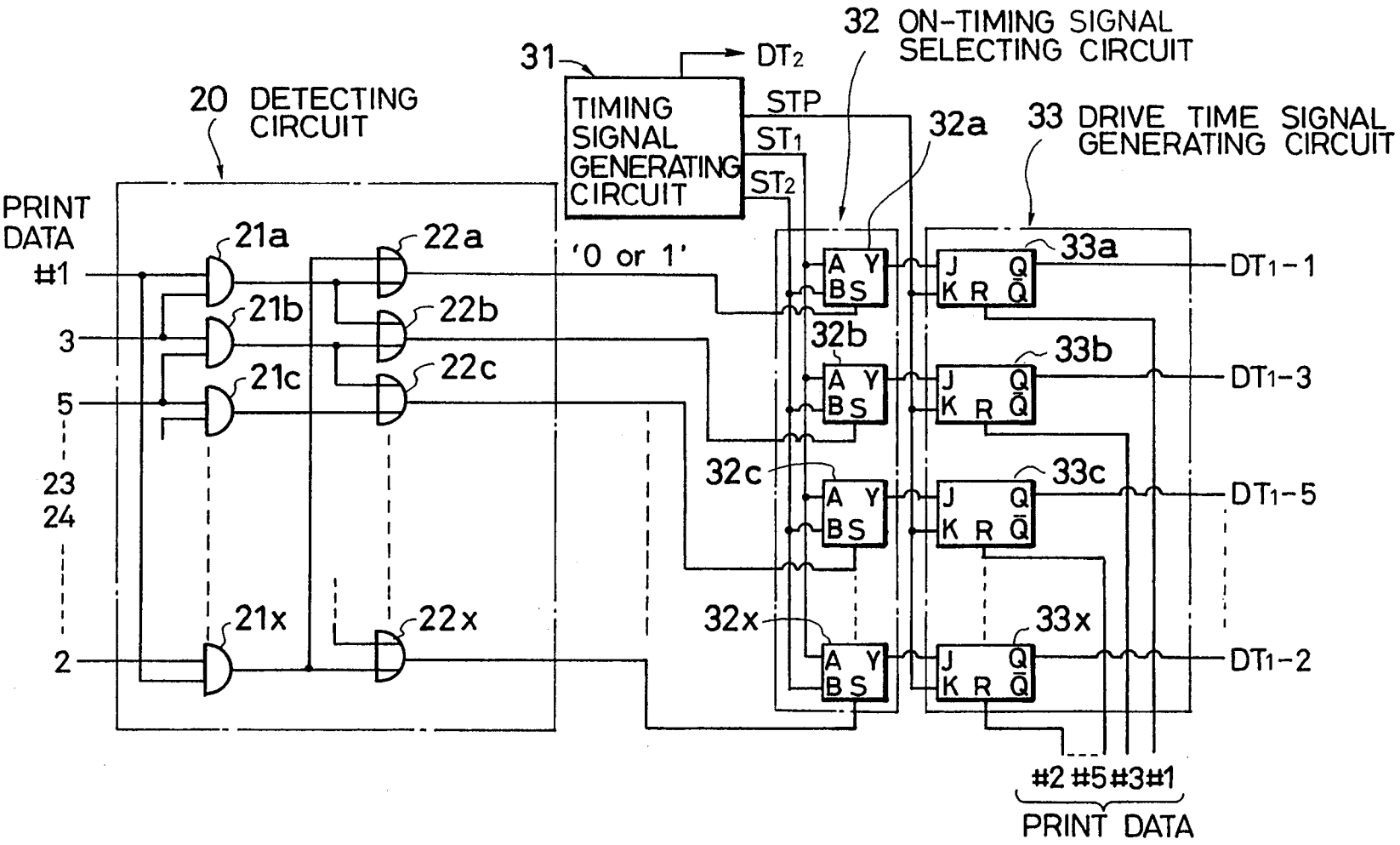
FIG. 9 is a block diagram showing the drive control circuit for a print head showing the second embodiment of the invention.

FIG. 9 is a circuit diagram showing a drive control circuit for the print head of a second embodiment of the invention. The difference from the first embodiment is that the leading edges of the drive time signals rather than the trailing edges are controlled for the purpose of varying the lengths of the energization times. For implementing such a scheme, the timing signal generating circuit 31, the on-timing signal selecting circuit 32 and the drive time signal generating circuit 33 have different configurations. The timing signal generating circuit 31 generates first and second on-timing signals $ST_1$ and $ST_2$ for turning on the drive time signals $DT_{1-1}$, $DT_{1-3}$, $DT_{1-5}$, . . . , $DT_{1-2}$, and a single off-timing signal STP for turning off the drive time signals $DT_{1-1}$, $DT_{1-3}$, $DT_{1-5}$, . . . , $DT_{1-2}$, in time with the generation of the print data. The drive time signal $DT_2$ is also generated.

The on-timing signal selecting circuit 32 comprises data selectors 32*a*, 32*b*, 32*c*, . . . , 32*x*, which receive at the data input terminals A and B the on-timing signals $ST_1$ and $ST_2$ generated by the timing signal generating circuit 31. They receive, at the data select terminals S, the detection signals from the detecting circuit 20, and responsive to the detection signal of "1" they select the signal being input to the terminal B and output it to the output terminal Y, and responsive to the detection signal of "0" they select the signal input to the terminal A and output it the output terminal Y. The drive time signal generating circuit 33 comprises JK flip-flops 33*a*, 33*b*, 33*c*, . . . , 33*x*. Input to the J terminal of each JK flip-flop are the output signals from the respective data selectors. Input to the K terminal of each JK flip-flop is the off-timing signal STP generated by the timing signal generating circuit 31. Input to the reset terminals R of the JK flip-flops 33*a*, 33*b*, 33*c*, . . . , 33*x* are print data #1, #3, #5, . . . , #2. The output signals $DT_{1-1}$, $DT_{1-3}$, $DT_{1-5}$, . . . , $DT_{1-2}$ of the JK flip-flops are the drive time signals for controlling the energization of the corresponding drive elements #1, #3, #5, . . . , #2, and are used in place of the drive time signal $DT_1$ mentioned in the description of the prior art. The drive time signal for each drive element of which an adjacent drive element is driven is turned on responsive to the on-timing signal $ST_2$, and is turned off with the off-timing signal STP. The drive time signals for other drive elements are turned on with the on-timing signal $ST_1$ and is turned off with the off-timing signal STP.

Figure 10:
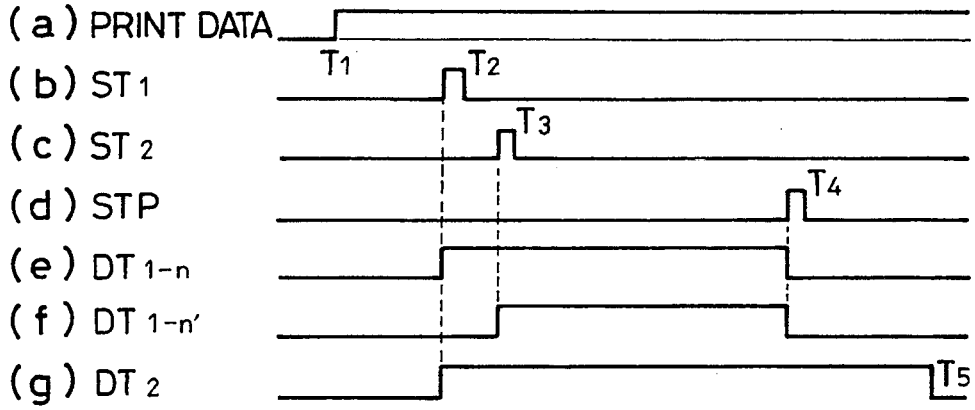
FIG. 10 is a time chart of the drive circuit for the print head shown in FIG. 9.

FIG. 10 is a time chart of the print head drive control circuit in FIG. 9. FIG. 10 shows, at (a), the print data #1, #3, #5, . . . , #2. FIG. 10 shows, at (b), (c) and (d), the on-timing signals $ST_1$, $ST_2$, and the off-timing signal STP generated by the timing signal generating circuit 31. FIG. 10 shows, at (e), the drive time signal $DT_{1-n}$ which is turned on and off with the on-timing signal $ST_1$ and the off-timing signal STP. FIG. 10 shows, at (f), the drive time signal $DT_{1-n'}$ which is turned on and off with the on-timing signal $ST_2$ and the off-timing signal STP. In the reference marks, the suffixes "n" and "n'" correspond to the numbers of the drive elements. FIG. 10 shows, at (g), the drive time signal $DT_2$.

In the same way as the first embodiment, the drive time signals $DT_{1-n}$, $DT_{1-n'}$ and $DT_2$ as well as the print data are input to the drive circuits of the drive elements to determine whether and when to energize the respective drive elements.

Figure 11:
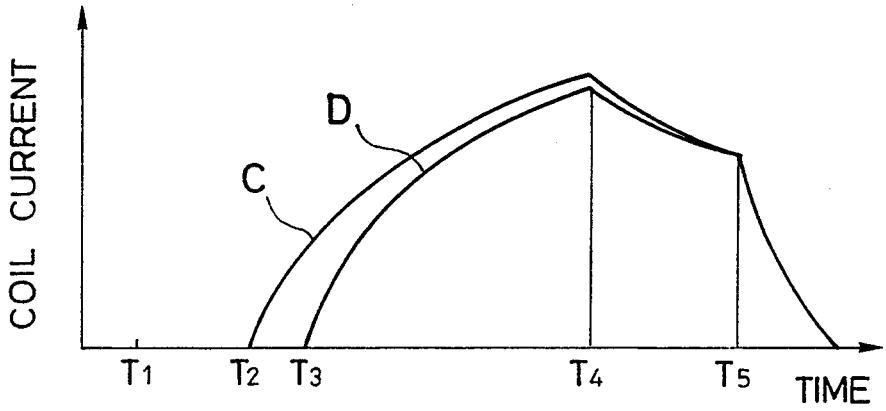
FIG. 11 is a waveform diagram of the coil currents corresponding to FIG. 10.

FIG. 11 shows waveforms of the coil currents corresponding to FIG. 10. The waveform C is for the drive time signal $DT_{1-n}$ and is obtained when the energization is commenced at $T_2$. The waveform D is for the drive time signal $DT_{1-n'}$ and is obtained when the energization is commenced at $T_3$.

The operation will now be described. As an example, it is assumed that the drive elements #5, #7, #9, #10, #12, #15 and #20 are driven, as in the first embodiment. The print data #1, #3, #5, . . . , #2 are input at time $T_1$ shown in FIG. 9, to the detecting circuit 20 shown in FIG. 9. The print data for the drive elements #5, #7, #9, #10, #12, #15 and #20 are at "1". The drive elements #5, #7, #9, #10 and #12 have their neighboring drive elements simultaneously driven, so the detection signals corresponding to the drive elements #5, #7, #9, #10, and #12 will assume level "1" and other detection signals will assume level "0". As a result, the data selectors 32*c*, 32*d*, 32*e*, 32*s* and 32*t* of the on-timing signal selection means 32 select the on-timing signals $ST_2$ and supply it to the drive time signal generating circuit 33. Other data selectors select the on-timing signal $ST_1$, and supply it to the drive time signal generating circuit 33.

At time $T_2$, the on-timing signal $ST_1$ rises to level "1", responsive to which the drive time signal $DT_{1-n}$ corresponding to the drive elements other than the drive elements #5, #7, #9, #10 and #12 rise to level "1". At time $T_3$, the on-timing signal $ST_2$ rises to level "1", responsive to which the drive time signals $DT_{1-n'}$ corresponding to the drive elements #5, #7, #9, #10 and #12 rise to level "1". Inputs to the drive circuits of the drive elements #15 and #20 are the drive time signals $DT_{1-n}$, $DT_2$ and the print data #15 and #20, and the drive elements are energized so as to conduct a current as indicated by waveform C in FIG. 11. Input to the drive circuits of the drive elements #5, #7, #9, #10 and

#12 are the drive time signals $DT_{1-n'}$, $DT_2$ and the print data #5, #7, #9, #10 and #12, and the drive elements are energized so as to conduct a current as indicated by waveform D shown in FIG. 11.

At time $T_4$, the off-timing signal STP rises to "1", responsive to which the JK flip-flops of the drive time signal generating circuit 33 shown in FIG. 9 operate, in accordance with clock pulses not shown, to set the drive time signals $DT_{1-n}$ and $DT_{1-n'}$ to "0". As a result, the energization of the drive elements #5, #7, #9, #10, #12, #15 and #20 (the current supply to the coils of the drive elements #5, #7, #9, #10, #12, #15 and #20 from the power supply Vcc) is terminated. At time $T_5$, the drive time signal $DT_2$ falls to level "0". The attenuation of the coil current due to the electromotive force rapidly falls as illustrated.

Figure 12:
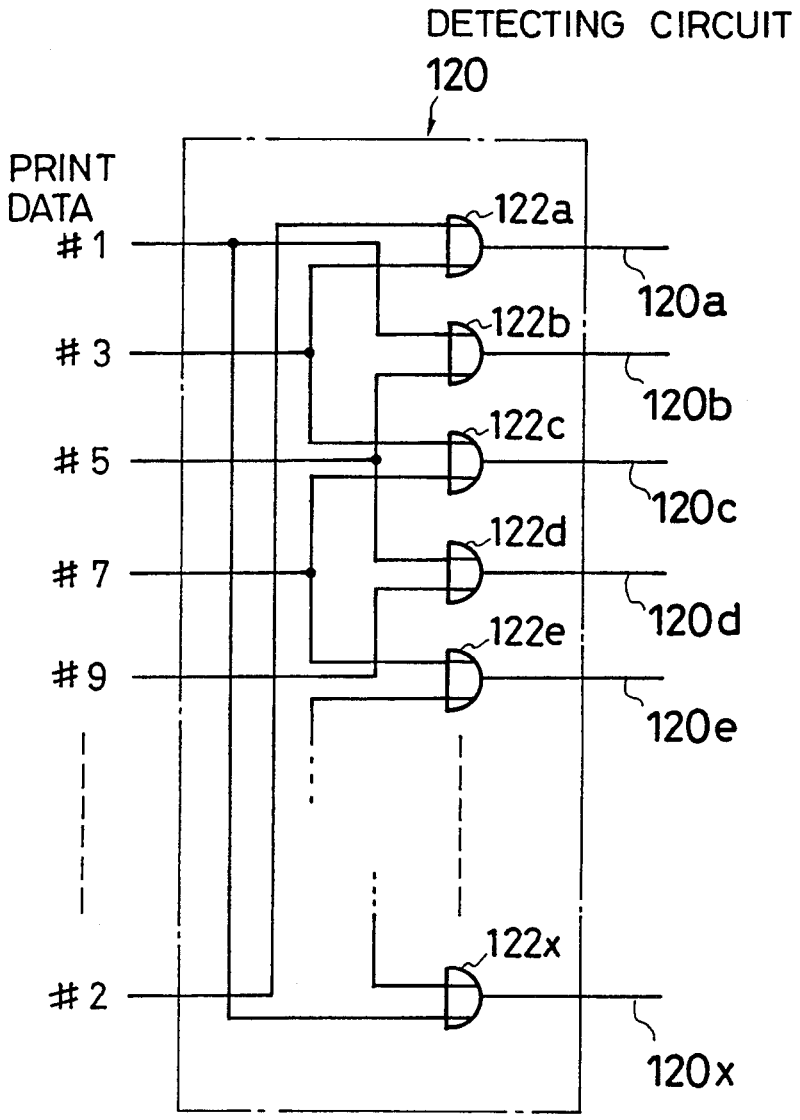
FIG. 12 is a circuit diagram showing a modification of a detecting circuit.

Various modifications are possible without departing from the spirit of the invention. For instance, although in the embodiments described, the detecting circuit 20 detects, for each drive element, whether said each drive element and at least one of the drive elements adjacent to the first-mentioned drive element are to be energized in the particular print cycle, the detecting circuit 20 may alternatively be so arranged to detect, for each of the drive elements, whether at least one of the drive elements adjacent to the first-mentioned drive element is driven during each print cycle. This can be implemented by a detecting circuit 120 shown in FIG. 12. It comprises OR gates 122*a* to 122*x* for the respective drive elements. Each OR gate for each drive element is connected to receive the print data for the drive elements adjacent to the drive element in question and using the output of the OR gate as the detection signal 120*a* to 120*x*. Using such detection signals will produce the same results since the drive elements are not actually energized unless the corresponding print data input to the AND gate 29 at the base of the driving transistor 30 is also active.

As has been described according to the invention, the energization time for each drive element is determined depending on whether or not an adjacent drive element is simultaneously energized: it is shortened if the adjacent drive element is also energized. Accordingly, supply of excessive energy to drive elements whose neighboring adjacent drive element is driven simultaneously is avoided, and the heating of the wire-dot print head is reduced, the print quality can be made uniform, and a high-speed wire-dot print head having a desirable armature operation can be provided.

What is claimed is:

1. A device for driving a wire-dot printer including a wire-dot print head having wire drive elements disposed in sequence, said device comprising:

means coupled to control energization of the respective wire drive elements in accordance with print data supplied for respective drive elements and timing signals supplied to said drive elements;

said print data for each said wire drive element indicating whether each said wire drive element is to be driven in each print cycle;

means coupled to said control means to detect, for each drive element, whether either adjacent drive element is energized, in accordance with the print data corresponding to said adjacent drive elements;

said means to detect whether either adjacent drive is energized consisting essentially of, for each print data element, an AND gate and an OR gate;

said control means being coupled to control the energization time for each said drive element in accordance with the result of the detection, said control means comprising:

a timing signal generating circuit to produce a first timing signal and a second timing signal;

a timing signal selecting circuit coupled to said timing signal generating circuit to select, for each drive element, either the first or the second timing signal in accordance with the print data corresponding to said adjacent drive elements;

a drive time signal generating circuit coupled to said timing signal selecting circuit and responsive to the selected one of the first and second timing signals to produce, for each drive element, a drive time signal having an active period and an inactive period, wherein said selected one of said timing signals determines the beginning of said drive time signal and wherein the end of said drive time signal is the same whether the first timing signal or the second timing signal is selected; and a drive circuit responsive to the drive time signal for causing, for each drive element, an electric current to flow through each of said wire drive elements, wherein the active period of said drive time signal has a shorter duration when said second timing signal is selected than when said first timing signal is selected.

2. The device of claim 1 wherein said timing signal generating circuit further generates an additional drive time signal; and wherein said drive circuit is also responsive to said additional drive time signal.

3. The device of claim 2 wherein said drive element comprises an electromagnet having a coil;

said drive circuit comprising:

a first switch coupling a first end of the coil to a power supply and turned on by said drive time signal;

a second switch coupling a second end of the coil to ground and turned on by said additional drive time signal;

said additional drive time signal being changed from active to inactive after said first-mentioned drive time signal is changed from active to inactive so that said second switch is turned off after said first switch is turned off;

a first diode connected across the series connection of said second switch and said coil to permit an electric current to flow through said coil, said second switch and said first diode when the first switch is turned off and said second switch is still on; and a second diode connected across the series connection of said first switch and the coil to permit an electric current to flow through the first diode, the coil, and the second diode when the second switch is also turned off.

4. A device for driving a wire-dot printer including a wire-dot print head having wire drive elements disposed in sequence, said device comprising:

control means coupled to control energization of the respective wire drive elements in accordance with print data supplied for respective drive elements and timing signals supplied to said drive elements;

said print data for each said wire drive element indicating whether each said wire drive element is to be driven in each print cycle;

means coupled to said control means to detect, for each drive element, whether either adjacent drive element is energized, in accordance with the print data corresponding to said adjacent drive elements;

said means to detect whether either adjacent drive is energized consisting essentially of, for each print data element, an AND gate and an OR gate;

said control means being coupled to control the energization time for each said drive element in accordance with the result of the detection, said control means comprising:

a timing signal generating circuit to produce a first timing signal and a second timing signal;

a timing signal selecting circuit coupled to said timing signal generating circuit to select, for each drive element, either the first or the second timing signal in accordance with the print data corresponding to said adjacent drive elements;

a drive time signal generating circuit coupled to said timing signal selecting circuit and responsive to the selected one of the first and second timing signals to produce, for each drive element, a drive time signal having an active period and an inactive period, wherein the beginning of the active period of said drive time signal is the same whether the first timing signal or the second timing signal is selected and wherein said timing signals determine the end of the active period of said drive time signal; and a drive circuit responsive to the drive time signal for causing, for each drive element, an electric current to flow through each of said wire drive elements, wherein the active period of said drive time signal has a shorter duration when said second timing signal is selected than when said first timing signal is selected.

5. The device of claim 4 wherein said timing signal generating circuit further generates an additional drive time signal; and wherein said drive circuit is also responsive to said additional drive time signal.

6. The device of claim 5 wherein said drive element comprises an electromagnet having a coil;

said drive circuit comprising:

a first switch coupling a first end of the coil to a power supply and turned on by said drive time signal;

a second switch coupling a second end of the coil to ground and turned on by said additional drive time signal;

said additional drive time signal being changed from active to inactive after said first-mentioned drive time signal is changed from active to inactive so that said second switch is turned off after said first switch is turned off;

a first diode connected across the series connection of said second switch and said coil to permit an electric current to flow through said coil, said second switch and said first diode when the first switch is turned off and said second switch is still on; and a second diode connected across the series connection of said first switch and the coil to permit an electric current to flow through the first diode, the coil, and the second diode when the second switch is also turned off.

7. A device for driving a wire-dot printer including a wire-dot print head having wire drive elements disposed in sequence, said device comprising:

a control circuit coupled to control energization of the respective wire drive elements in accordance with print data supplied for respective drive elements and timing signals supplied to said drive elements;

said print data for each said wire drive element indicating whether each said wire drive element is to be driven in each print cycle;

a circuit coupled to said control circuit to detect, for each drive element, whether either adjacent drive element is energized, in accordance with the print data corresponding to said adjacent drive elements;

said circuit to detect whether either adjacent drive is energized consisting essentially of, for each print data element, an AND gate and an OR gate;

said control circuit being coupled to control the energization time for each said drive element in accordance with the result of the detection, said control means comprising:

a timing signal generating circuit to produce a first timing signal and a second timing signal;

a timing signal selecting circuit coupled to said timing signal generating circuit to select, for each drive element, either the first or the second timing signal in accordance with the print data corresponding to said adjacent drive elements;

a drive time signal generating circuit responsive to the selected one of the first and second timing signals for producing, for each drive element, a drive time signal having an active period and an inactive period, wherein said timing signals determine the beginning of the active period of said drive time signal and wherein the end of the active period of said drive time signal is the same whether the first timing signal or the second timing signal is selected; and a drive circuit responsive to the drive time signal for causing, for each drive element, an electric current to flow through each of said wire drive elements, wherein said drive time signal has a shorter active period when said second timing signal is selected than when said first timing signal is selected.

8. The device of claim 7 wherein said timing signal generating circuit further generates an additional drive time signal; and wherein said drive circuit is also responsive to said additional drive time signal.

9. The device of claim 8 wherein said drive element comprises an electromagnet having a coil;

said drive circuit comprising:

a first switch coupling a first end of the coil to a power supply and turned on by said drive time signal;

a second switch coupling a second end of the coil to ground and turned on by said additional drive time signal;

said additional drive time signal being changed from active to inactive after said first-mentioned drive time signal is changed from active to inactive so that said second switch is turned off after said first switch is turned off;

a first diode connected across the series connection of said second switch and said coil to permit an electric current to flow through said coil, said second switch and said first diode when the first switch is turned off and said second switch is still on; and a second diode connected across the series connection of said first switch and the coil to permit an electric current to flow through the first diode, the coil, and the second diode when the second switch is also turned off.

10. A device for driving a wire-dot printer including a wire-dot print head having wire drive elements disposed in sequence, said device comprising:

a control circuit coupled to control energization of the respective wire drive elements in accordance with print data supplied for respective drive elements and timing signals supplied to said drive elements;

said print data for each said wire drive element indicating whether each said wire drive element is to be driven in each print cycle;

a circuit coupled to said control circuit to detect, for each drive element, whether either adjacent drive element is energized, in accordance with the print data corresponding to said adjacent drive elements;

said circuit to detect whether either adjacent drive is energized consisting essentially of, for each print data element, an AND gate and an OR gate;

said control circuit being coupled to control the energization time for each said drive element in accordance with the result of the detection, said control means comprising:

a timing signal generating circuit to produce a first timing signal and a second timing signal;

a timing signal selecting circuit coupled to said timing signal generating circuit to select, for each drive element, either the first or the second timing signal in accordance with the print data corresponding to said adjacent drive elements;

a drive time signal generating circuit responsive to the selected one of the first and second timing signals for producing, for each drive element, a drive time signal having an active period and an inactive period, wherein the beginning of the active period of said drive time signal is the same whether the first timing signal or the second timing signal is selected and wherein said timing signals determine the end of the active period of said drive time signal; and a drive circuit responsive to the drive time signal for causing, for each drive element, an electric current to flow through each of said wire drive elements, wherein drive time signal has a shorter active period when said second timing signal is selected than when said first timing signal is selected.

11. The device of claim 10 wherein said timing signal generating circuit further generates an additional drive time signal; and wherein drive circuit is also responsive to said additional drive time signal.

12. The device of claim 11 wherein said drive element comprises an electromagnet having a coil;

said drive circuit comprising:

a first switch coupling a first end of the coil to a power supply and turned on by said drive time signal;

a second switch coupling a second end of the coil to ground and turned on by said additional drive time signal;

said additional drive time signal being changed from active to inactive after said first-mentioned drive time signal is changed from active to inactive so that said second switch is turned off after said first switch is turned off;

a first diode connected across the series connection of said second switch and said coil to permit an electric current to flow through said coil, said second switch and said first diode when the first switch is turned off and said second switch is still on; and a second diode connected across the series connection of said first switch and the coil to permit an electric current to flow through the first diode, the coil, and the second diode when the second switch is also turned off.

* * * * *